United States Patent [19]

Fox

[11] 4,369,640

[45] Jan. 25, 1983

[54] APPARATUS FOR OBTAINING UNIFORM SOLID COLORS OR VARIEGATED PATTERNS IN FABRICS

[75] Inventor: Gary R. Fox, Ringgold, Ga.

[73] Assignee: Wadsworth-Greenwood Corporation, Fort Oglethorpe, Ga.

[21] Appl. No.: 227,939

[22] Filed: Jan. 23, 1981

Related U.S. Application Data

[63] Continuation-in-part of Ser. No. 179,752, Aug. 20, 1980, abandoned.

[51] Int. Cl.[3] ..... D06B 1/06

[52] U.S. Cl. ..... 68/205 R; 137/561 A; 137/883; 239/553.3

[58] Field of Search ..... 68/200, 205 R; 118/324, 118/325; 239/553, 553.3; 137/561 A, 883

[56] References Cited

U.S. PATENT DOCUMENTS

| | | | |
|---|---|---|---|
| 596,905 | 1/1898 | McCoy . | |
| 1,948,568 | 4/1930 | Faber et al. | 68/5 C X |
| 1,964,257 | 6/1934 | Gilmore . | |
| 2,218,811 | 10/1940 | Chausabel | 68/205 R X |
| 2,537,290 | 1/1951 | Williams et al. | 68/200 X |
| 2,680,079 | 6/1954 | Heubner . | |
| 2,697,637 | 12/1954 | Mittelstadt | 239/553.3 X |
| 3,127,014 | 11/1978 | Miller et al. | 68/205 R X |
| 3,155,540 | 11/1964 | Loeffler et al. | 118/60 |
| 3,256,581 | 6/1966 | Thal et al. | 26/2 R |
| 3,431,889 | 3/1969 | Fraatz | 118/315 |
| 3,452,710 | 7/1969 | Hentschel | 118/324 X |
| 3,660,994 | 5/1972 | Gowin | 68/205 R |
| 3,667,258 | 6/1972 | Newton | 68/205 R |
| 3,683,649 | 8/1972 | Takriti et al. | 68/205 R X |
| 3,688,530 | 9/1972 | Harris et al. | 68/205 R |
| 3,694,142 | 9/1972 | Schniorer | 8/151 |
| 3,717,722 | 2/1973 | Messner | 118/624 X |
| 4,010,709 | 3/1977 | Sayman et al. | 68/205 R X |
| 4,023,526 | 5/1977 | Ashmus et al. | 118/410 |
| 4,099,913 | 7/1978 | Walter et al. | 8/173 |
| 4,108,595 | 8/1978 | Pappas | 8/149 X |
| 4,118,526 | 10/1978 | Gregorian et al. | 427/350 |
| 4,141,231 | 2/1979 | Kudlich | 68/205 R |
| 4,170,883 | 10/1979 | Varner | 68/205 R |
| 4,170,958 | 10/1979 | Moser | 118/325 |
| 4,193,762 | 3/1980 | Namboodri | 68/200 X |
| 4,208,173 | 6/1980 | Gregorian et al. | 8/477 X |
| 4,254,644 | 3/1981 | Bartlett et al. | 68/205 R |
| 4,277,960 | 7/1981 | McKendrick et al. | 68/205 R |

FOREIGN PATENT DOCUMENTS

| | | | |
|---|---|---|---|
| 47495/79 | 6/1979 | Australia . | |
| 2416259 | 10/1975 | Fed. Rep. of Germany | 68/200 |
| 316382 | 11/1956 | Switzerland | 68/205 R |
| 1288681 | 9/1972 | United Kingdom | 68/205 R |
| 1296725 | 11/1972 | United Kingdom | 68/205 R |
| 2022017 | 12/1979 | United Kingdom | 68/205 R |

*Primary Examiner*—Philip R. Coe

*Attorney, Agent, or Firm*—Sherman & Shalloway

[57] ABSTRACT

The present invention relates to a novel apparatus and method for the dyeing of fabrics by passing the fabric adjacent a flat applicator, forming a continuous sheet of a dye coating of sufficiently low viscosity to penetrate the fabric and delivering the coating to the applicator's edge, and applying the coating to the fabric as a continuous sheet flowing from the applicator's edge directly onto the surface of the passing fabric. The system of this invention may apply the dye coating as a liquid or a foamed liquid.

Additional nozzle assemblies may be provided in order to permit separate discharge of dye color or to produce variegated color patterns on the fabric.

16 Claims, 16 Drawing Figures

129
128
127
126
67
51
79
30
63
13
39
85
13
F
43
29
31
16
105
83
83
35
91
91
89
105
16
88
107
107
37

129
7
7
128
127
126
12
212
51
65
12
121
39
41
45
47
193
F
30
201

129
61
139
131
128
138
123
177
127
137
131
126
136
67
123
59
61
223
227
57
229
53
51
63
65
81
79
121
81
47
177
41
39
F
29
89
31
205
88
203
30

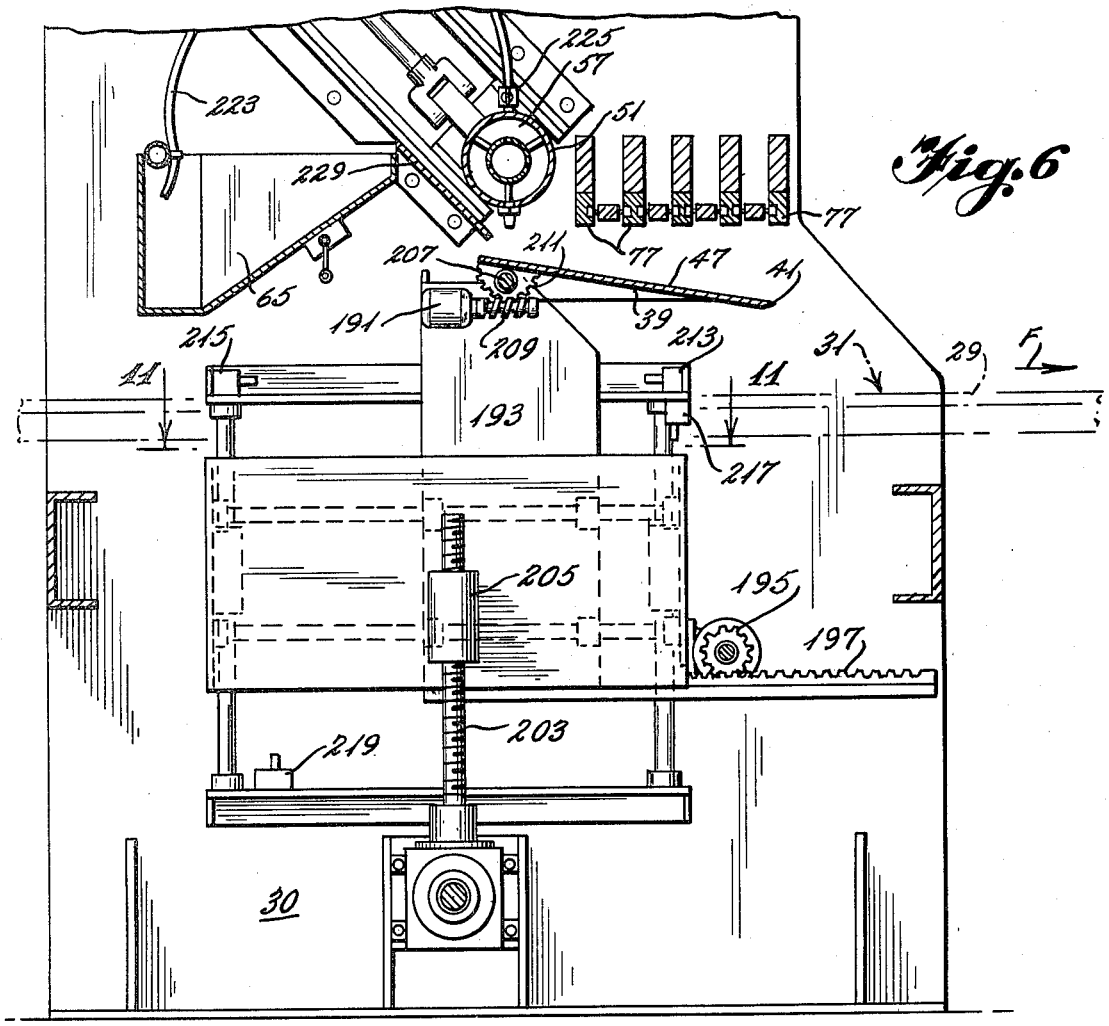
Fig. 6
Fig. 11
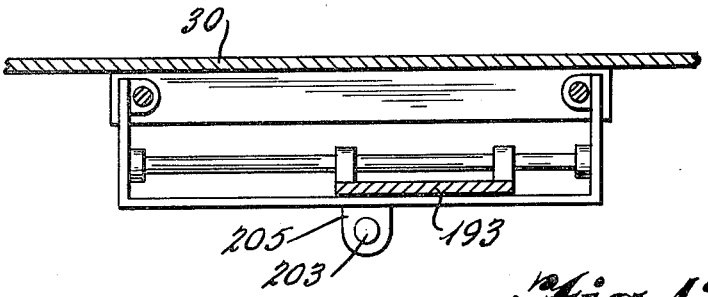
Fig. 12
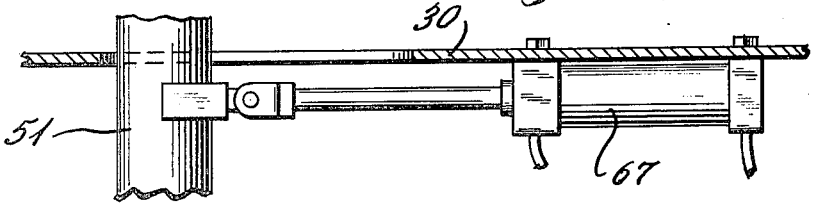

APPARATUS FOR OBTAINING UNIFORM SOLID COLORS OR VARIEGATED PATTERNS IN FABRICS

CROSS-REFERENCE TO RELATED APPLICATION

This is a continuation-in-part of my copending application Ser. No. 179,752, filed Aug. 20, 1980, and now abandoned the entire specification and drawings of which are incorporated by reference.

BACKGROUND OF THE INVENTION

The present invention relates to the dyeing of dye penetrable fabrics and, more particularly, relates to the dyeing of tufted pile fabrics, such as carpeting, in a continuous process after the fabric has been tufted or woven.

In many cases it is desired to produce a variegated pattern of colors in which different hues or shades "fade in" at controlled portions of the fabric. These variegated patterns may be uniformly displaced throughout the fabric or may be used to create a changed effect across the width of the fabric. Usually it is desired that, unless the changes in hue or shade are accomplished along a sharp line as in printed fabrics or oriental carpets, the fade-in is "soft," not defining any distinct line of change.

Quite obviously, the use of the variegated color patterns in carpeting is quite limited therefore a manufacture also desires a dyeing machine that would be able to produce solid colors. For this reason, a machine capable of producing these variegated color patterns should also be capable of dyeing in a single hue.

With respect to the dyeing of carpets, there are several prior art techniques. The traditional method is to dye the yarns before they are woven or tufted to form the carpet. While this technique enables the production of intricate patterns and eliminates a separate dye step after the tufting of carpets, it also has several disadvantages. These include the difficulty of obtaining precise color matches, the necessity to decide on color mix of a final carpet product prior to tufting and, above all, the high cost of colored yarns. As a result, it is common practice to dye carpets after they have been tufted.

One method of dyeing carpet is a dye beck system. In the dye beck system, a roll of carpet is unrolled into a large stainless steel chamber. The carpet is looped around stainless steel feed rolls and immersed in a hot dye solution in the lower portion of the chamber. The carpet is continuously looped into the solution for a cycling time, typically an hour, after which it is placed in a stainless steel buggy to be transported to a dryer to dry. Thus, the dye beck is said to operate on a noncontinuous basis.

Another present system being utilized is the Kuster applicator using a doctor bar. The Kuster applicator has difficulty in operating at a wide viscosity range (of dye substances).

Another system is a standard pad machine. The pad machine exhibits difficulties in obtaining an even coating, presumably because of differences in pressures exerted by the pad along the carpet roll face. This results in light and dark shades along the length of carpet.

OBJECTS OF THE INVENTION

It is an object of the present invention to provide an inexpensive method of coating various types of fabrics, including tufted fabrics and carpets, on a continuous basis which is less expensive and more efficient than the methods that exist presently in the market.

Another object is to provide an inexpensive method of coating heavy fabrics such as tufted carpet on a continuous basis in a manner that would result in uniform coloration where desired.

It is a further object to provide a system for dyeing fabrics on a continuous basis which will provide predictable results and can use minimal quantities of dye substances. It is therefore an object to provide a system for continuously dyeing fabrics which can apply the dyes to the carpets as a foam.

It is a further object to provide a system for dyeing carpet on a continuous basis in which dye substances may be added to a coating material during a discharge of the coating material in such a way that the coating material reaches a fabric with the coating material interdispersed in either a solid or a variegated pattern. The control of the interdispersion of the dye substance and the coating material is intended to enhance the optical "texture" of the carpet.

It is yet a further object of the invention to provide a machine which can be used to provide a uniform coating of the material and has a capability of providing additional dye substances to the coating material prior to the application of the coating material to the fabric when it is so desired to add the additional coating materials.

It is a further object of the present invention to provide diffuse, variegated dye coating on fabrics.

It is another object of the present invention to provide variegated, interdiffused color patterns in dye penetrable fabrics.

It is another object of the present invention to provide a means to provide uniform and variegated dye patterns in fabrics of a wide variety and fabrics having diverse applicators.

It is a further object of the present invention to provide variegated and interdispersed color patterns in pile fabrics by predispersion of multiple dyes as a continuous sheet of penetrating coating prior to the application thereof to the fabric.

It is a further object of the present invention to provide for the variegated-pattern penetration of dyes into pile fabrics with improved distribution of the dyes along the length of the individual tufts of the pile.

A further object of the invention is the provision of a system for selectively producing variegated patterns on dye penetrable fabrics while requiring minimal alterations in existing dye lines.

A further object of the invention is the provision of a system for producing variegated patterns in dye penetrable carpet fabrics with sufficient diffusion of the differing dye areas to prevent the distinct or optically finite borders between adjacent colors which are typical of present systems.

A further object of the invention is the provision of a system for producing variegated patterns in dye penetrable pile fabrics for use as carpeting in which the colors of the variegated pattern are not only interdiffused but also distributed more uniformally along the length of the individual tufts to reduce the visible consequences which otherwise follow from heavy wear in local areas when the pattern is not uniformly applied to the tufts.

SUMMARY OF THE INVENTION

In one aspect of the invention, an apparatus for producing dye patterns in fabrics comprises an applicator having an applicator surface whose edge is positionable across the width of a moving web of fabric and a means for delivering a coating material onto the applicator surface.

Moreover, a further aspect of the present invention is the provision of a means for delivering the coating material onto the fabric which is made onto a pair of concentric tubes, with the coating material being delivered to the innermost tube and flowing, first between the inner and outer tubes and then out of a plurality of outlet ports spaced above the applicator plate. The tube assembly may be withdrawn over a trough in order to discontinue flow onto the applicator plate. Additionally, the applicator plate may be adjustable in position, thus varying the rate of gravity feed of the coating material from the applicator plate onto the moving fabric. The applicator plate may be completely withdrawn so as to permit the coating material to flow directly from the outlet ports onto the fabric.

Furthermore, the above-described apparatus may be provided with an additional dye dispensing means so that additional amounts of dye may be deposited onto the coating material either while the coating material is on the applicator plate, or as the coating material is settling on the fabric.

In a further aspect of the invention, a method for dyeing fabrics is provided in which a fabric is passed closely adjacent an applicator and a continuous sheet of dye coating substance is placed on the applicator. The sheet is advanced to the fabric by gravity feed, permitting the dye coating substance to pass over an edge of the applicator onto the fabric. The time necessary for the sheet to move to the applicator edge permits the innerdispersion of coating materials in the dye coating substance prior to the dye coating substance contacting the fabric.

In yet a further aspect of the present invention, a method is provided which comprises the dyeing of fabrics in variegated patterns by passing the fabric adjacent an applicator edge, forming a continuous sheet of a first coating of sufficiently low viscosity to penetrate the fabric, delivering discrete units of a second coating onto said continuous sheet of first coating, said second coating being of a viscosity sufficiently low to penetrate the fabric, permitting said first and second coatings to interdisperse and delivering the interdispersed coatings to the fabric as a continuous sheet flowing from the applicator edge directly onto the surface of the passing fabric and the apparatus therefor.

Additionally, the apparatus of the present invention comprises an applicator plate having an applicator edge positionable across the width of a moving length of fabric, the plate having a smooth upper surface inclined toward the applicator edge, means including plural nozzles positioned for delivery of coating materials upstream of the applicator edge, and control means for selectively delivering a second coating material through selected nozzles to interdisperse with the sheet of first coating material upon the upper plate surface.

In still a further aspect of the present invention a method to provide for the dyeing of fabrics by passing the fabric adjacent an application edge, forming a continuous sheet of a coating material in the form of a foam having a viscosity sufficiently low to penetrate the fabric, causing the foam to flow as a continuous sheet from the applicator edge directly onto the surface of the passing fabric, and permitting the foam to be absorbed into the fabric is shown. It is possible to add additional coating materials, such as coloring dyes, to the continuous sheet of foam prior to the foam being absorbed by the fabric.

Yet still another aspect of the present invention is the provision of an apparatus which comprises an applicator blade having an applicator edge positionable across the width of a moving length of fabric, the plate having a smooth upper surface inclined toward the applicator edge and means including plural nozzles positioned for the delivery of a foamed coating material upstream of the applicator edge, so that foam may be effused onto the applicator plate, then flow over the applicator edge onto the floating length of fabric and be absorbed into the fabric. Additional nozzles may be positioned for the deliver of additional coating materials onto the foam.

BRIEF DESCRIPTION OF THE DRAWINGS

The foregoing summary and the preceding objects of the invention impart a general understanding of the nature and the purposes thereof. These and other objects of the invention, as well as a better understanding thereof, may be derived from the following description and the accompanying drawing, in which:

FIG. 6 is a right side sectional view taken along section 6—6 of FIG. 4, showing the adjustment of the applicator plate.

FIG. 11 is a sectional view of the applicator plate adjustment, taken along section 11—11 of FIG. 6.

FIG. 12 shows the main coating retracting apparatus, taken along section 12—12 of FIG. 3.

DETAILED DESCRIPTION OF THE PREFERRED EMBODIMENT

Figure 1:
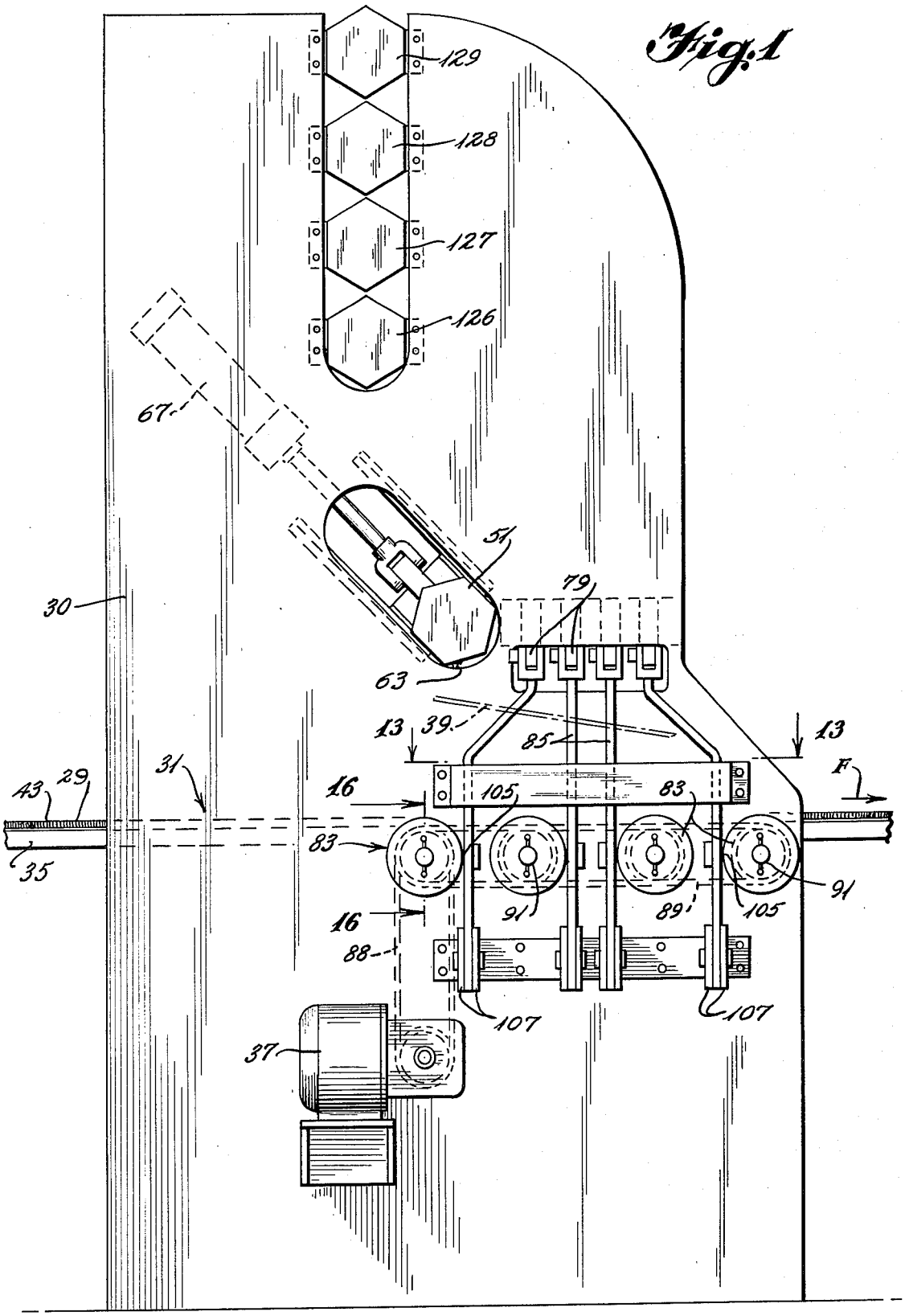
FIG. 1 is a right side view of the apparatues according to the invention.

As shown in the drawings, the preferred form of the invention is embodied in an installation for producing a dyed run of pile fabric 29 for use as carpeting, see FIG. 1. It is to be understood, however, that other types of dye penetrable fabrics may be patterned by the method and apparatus of the invention where either a uniform solid color or a diffused variegation of colors is desired. The present invention has been found to be effective on woven and knit fabrics as well as the pile fabric depicted in the drawings.

Referring to FIGS. 1–6, the preferred system of the present invention is installed on a conventional dye line having rollers (not shown) and a supporting bed 35. Conventional means for advancing the fabric, such as a drive motor (not shown) for rotating the rollers, may be utilized and the dye line 31 may include other stations for treating the fabric 29, such as drying means (not shown).

The apparatus includes an applicator plate 39 mounted above the bed 35 and located within the dye line 1 and having a straight applicator edge 41 positioned closely adjacent the plane of the upper ends of the tufts 43 in the pile fabric 29. The edge 41 is formed by relieving the lower corner 45 (shown in FIG. 3) of the plate to produce a knife-like straightedge and is aligned substantially at the right angle with respect to the linear path of travel of the fabric 29, as indicated by arrow F (as shown in FIGS. 1, 3, 5 and 6).

The plate 39 includes a flat and smooth upper surface 47 which slopes downwardly toward edge 41 at an angle which is varied from about 2° to about 15° with respect to the horizontal. The plate 39 also preferably is moveable to differing positions and angles for different dyes and fabrics which may be effected by any desired means, such as a plate bias adjustment means 49, which will be described later.

Figure 5:
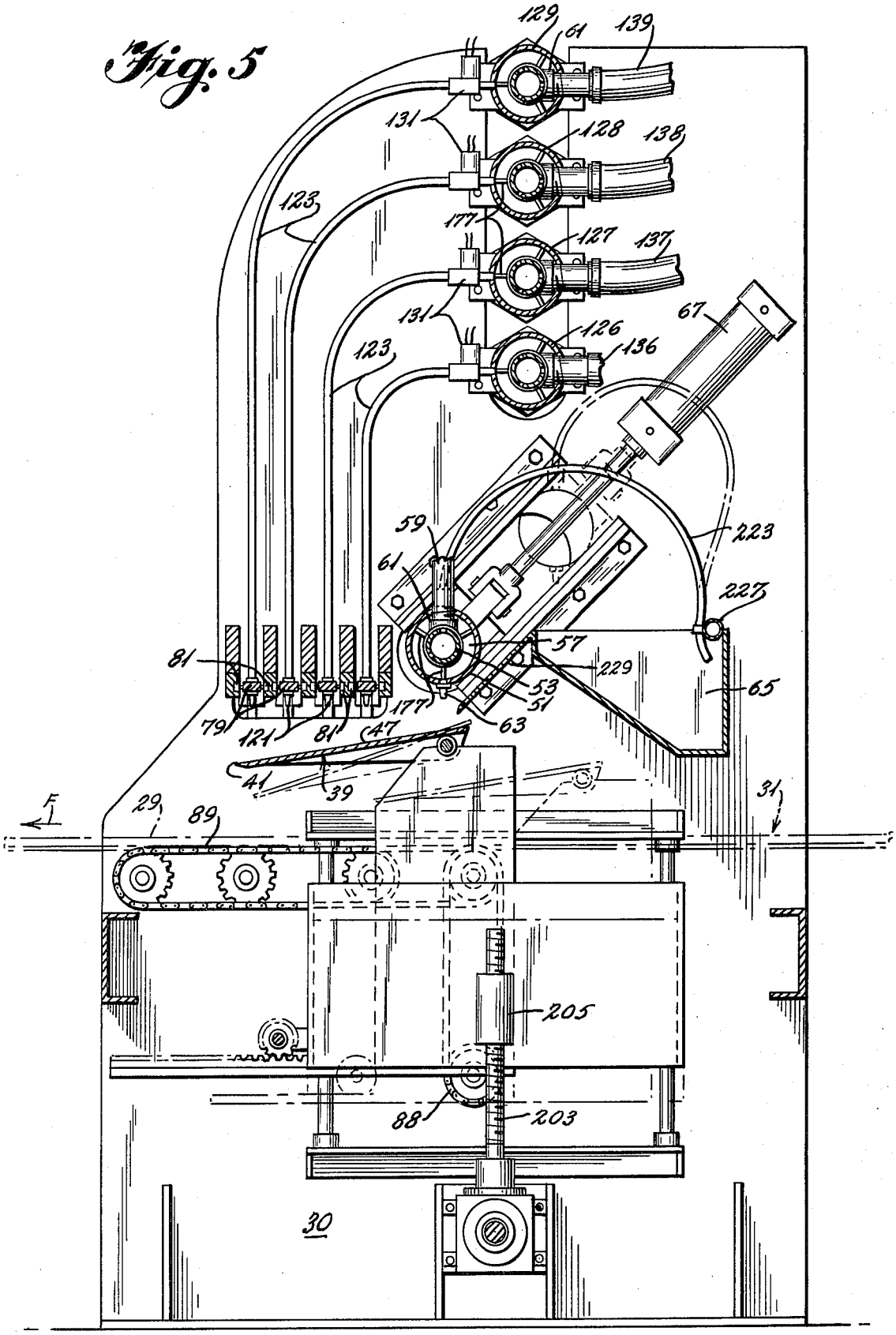
FIG. 5 is a left side sectional view of the apparatus according to the invention showing the relative positions of the distributors, taken on the line 5—5 of FIG. 2.

In FIGS. 5 and 6 a main coating distributor 51 is located above the dye line 31. Main coating distributor 51 is provided with an inner tube 53 and an outer tube 55, forming an annular chamber 57. Fluid is permitted to flow into the inner tube 53 from a flexible supply pipe 59 by Tee fitting 61. Fluid in the inner tube is transferred to the annular chamber 57, a continuous slot or aperture (not shown) (broken by Tee fitting 61) is provided in a row along the top of inner tube 53 to permit the transfer of the fluid to the annular chamber 57.

At the lower portion of the outer tube 55 is a plurality of main outlet ports 63 which communicate with the annular chamber 57. The main outlet ports 63 are evenly spaced in rows and each form nozzles permitting fluid from the annular chamber 57 to effuse therefrom.

A recycling trough 65 is located in a plane between the vertical position of the plate 39 and the main coating distributor 51 may be reciprocated over the trough 65. Referring particularly to FIG. 5, suitable reciprocating means such as a pair of pneumatic cylinders 67 reciprocate the main coating distributor 51 so that in a retracted position, indicated by dashed lines 69, the coating material effusing from the main coating distributor 51 is recovered by the recycling trough 65 and in an extended position, indicated by the solid lines at 51, the coating material is effused onto the surface 47. The recycling trough 65 has an arrangement of a drainage tube and pump (not shown) which can be connected so as to recycle the coating material falling therein.

In FIGS. 5 and 6, a plurality of transverse guide tracks 71 may be installed above the applicator plate 39. The system is designed to function without the addition of the tracks 77 and nozzle bars 79. Accordingly, these elements may be made optional or installed after the system has been in operation.

Figure 2:
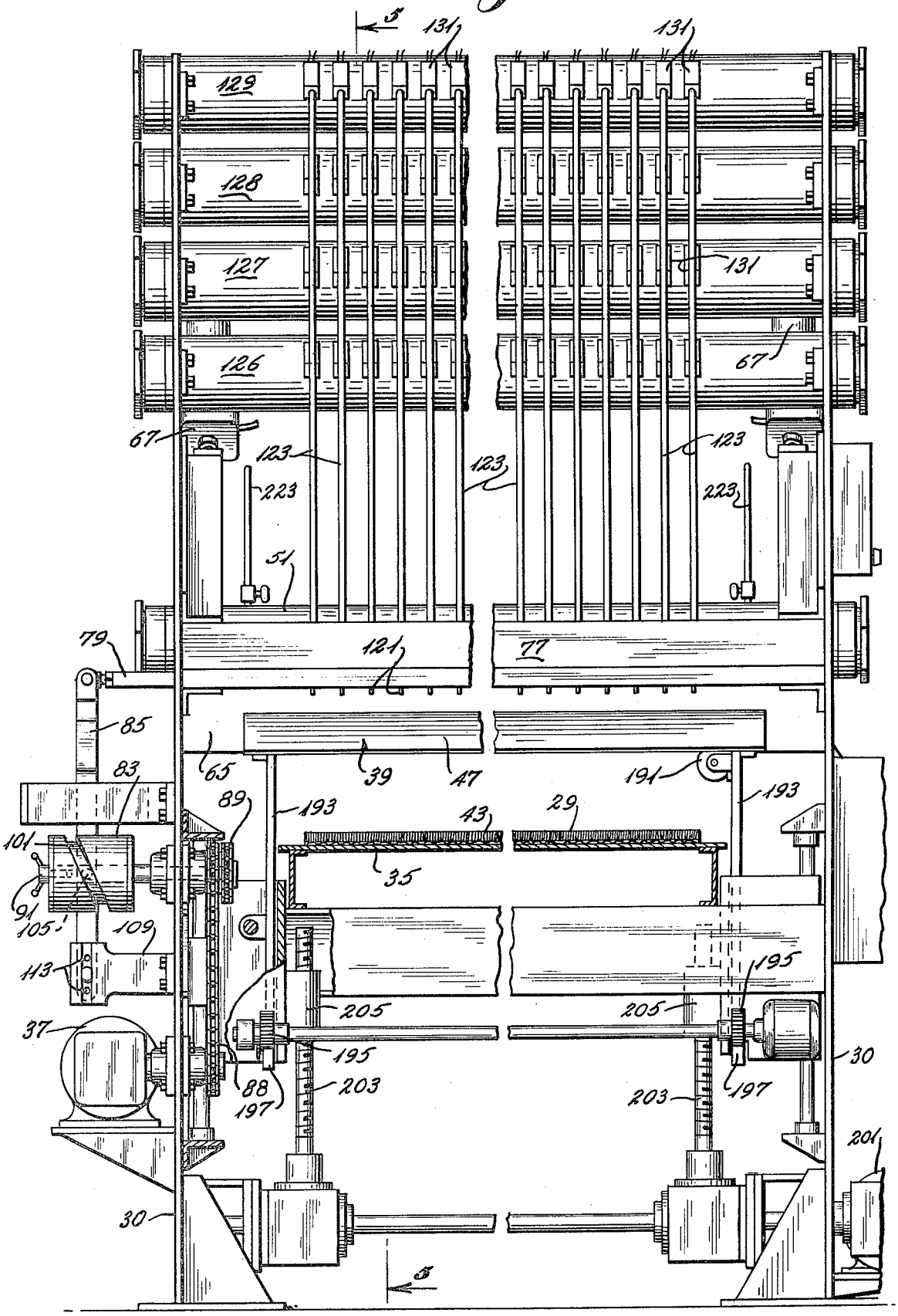
FIG. 2 is a front view of the apparatus according to the invention.
Figure 4:
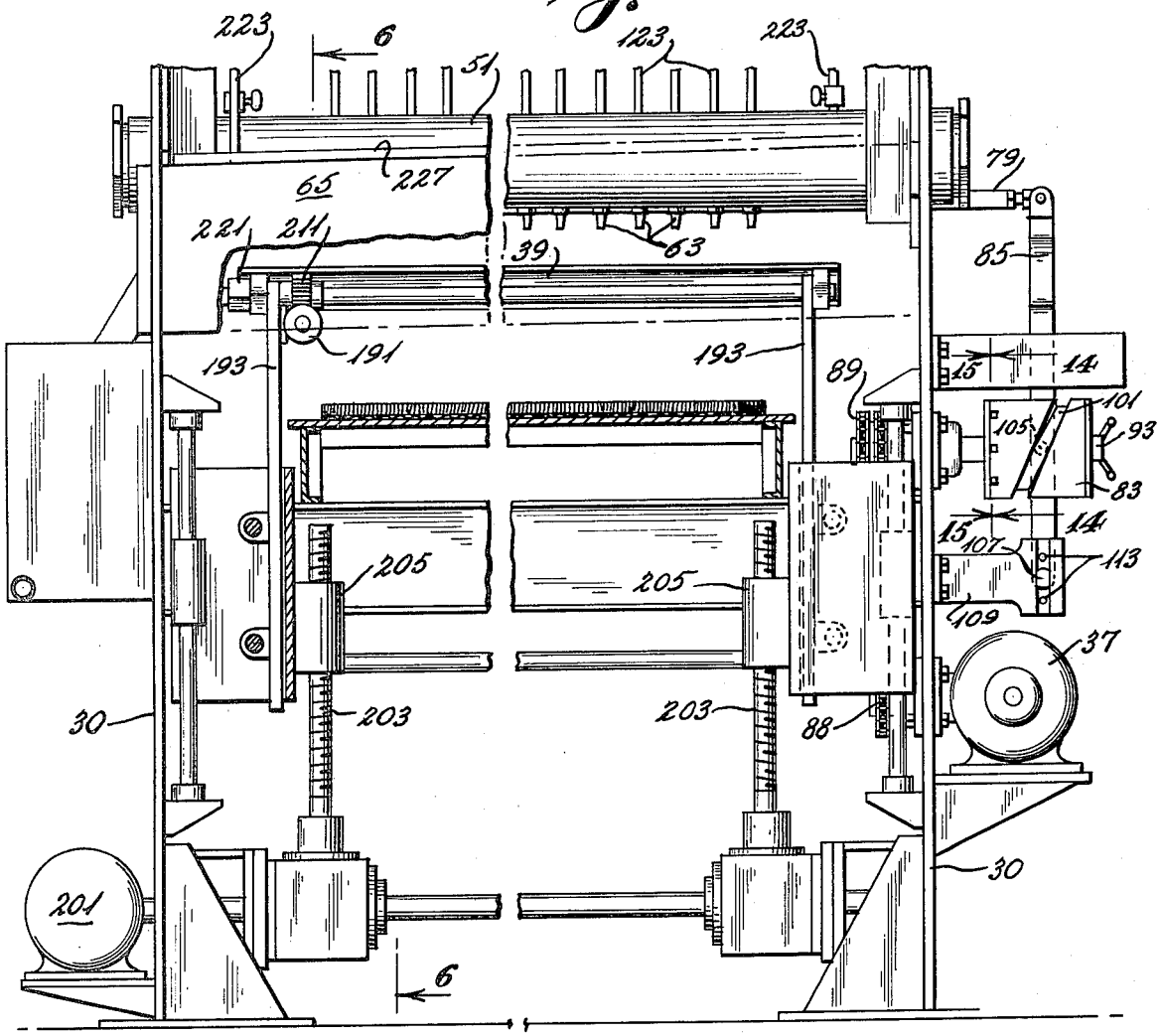
FIG. 4 is a rear view of the apparatus according to the invention.

The nozzle bars 79 preferably are mounted in the tracks 77 by means of rollers 81 and are driven by any suitable means such as the cam system (as shown in FIGS. 1, 2 and 4).

Figure 13:
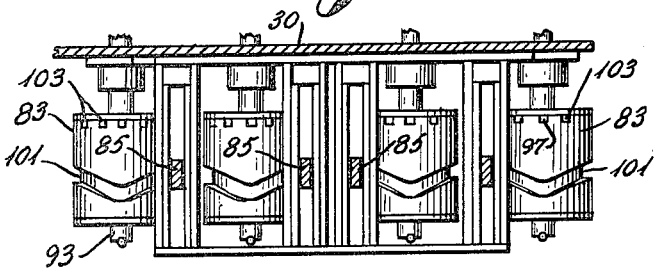
FIG. 13 shows the cam and lever drive assembly for the reciprocating nozzle bars, taken along section 13—13 of FIG. 1.
Figure 14:
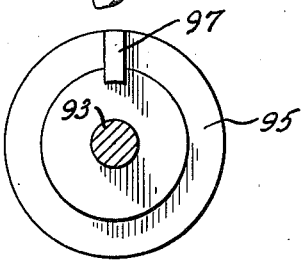
FIGS. 14 and 15 show the mandrel and cylinder components, respectively, of the cam assembly, taken along sections 14—14 and 15—15 of FIG. 4.
Figure 15:
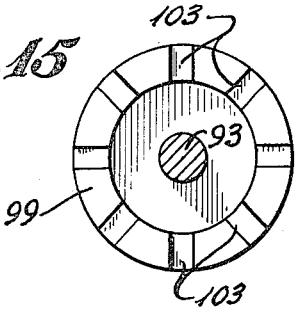

In FIGS. 1, 4 and 13, the cam system comprises a plurality of slotted drums 83, with one drum 83 driving each nozzle bar 79 through a cam following lever arm 85. The drums 83 are connected to a single drive motor 87 by drive chains 88 and 89 by means of a speedball nut 91. The engagement of the drum 83 with its drive components can thus be controlled by the operator tightening the speedball nut 91.

A separate lever arm 85 is provided for each of the several nozzle bars 79 so that they may be installed and operated separately and selectively. It should be noted that the several nozzle bars 79 are interdependently driven by a single motor. However, if desired, one could utilize individual motors for driving each of the nozzle bars.

Figure 16:
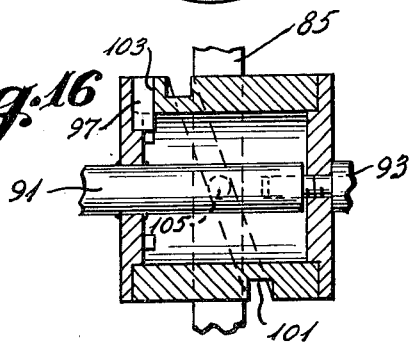
FIG. 16 shows the cam assembly, taken along section 16—16 of FIG. 1.

In FIGS. 1, 4 and 13–16, the slotted drums 83 are selectively engaged by a dog and recess arrangement in the drums 83 and secured with the aid of speedball nuts 91. Referring to FIG. 16, each drum 83 has a shaft member 93 directly driven by drive chains 88, 89, as shown in FIG. 1. As further shown in FIG. 16, a mandrel plate 95 is welded to shaft 93 with the mandrel plate 95 having a dog 97 fixed thereto. A cylindrical member 99 having a cam path 101 cut thereon may be mounted on the shaft 93 and secured by the speedball nut 91. The cylindrical member 99 has eight slots 103 cut from one end thereof, with the slots 103 and the dog 97 acting as a coupling gear to rotationally engage the cylindrical member 99 with the mandrel plate 95 to cause the cylindrical member to be driven (through shaft 93 and mandrel plate 95) by the drive chains 88, 89. By providing eight slots 103 on each cylindrical member 99, any cylindrical member 99 may be selectively positioned in any of eight angular positions. Obviously, with different slot arrangements, different angular relationships could be achieved.

As can be seen in FIG. 4, each lever arm 85 is provided with a cam following pin 105 which fits within the cam path 101. One end 107 of each cam arm functions as a stationary pivot point and is fixed to the frame 30 of the apparatus with an arm mounting bracket 109. The opposite end of each lever arm 85 is pivotally attached to its respective nozzle bar 79 and forms a nozzle bar pivot point 111. The cam following pin 105 is located approximately a third of the distance from the stationary pivot point 107 to the nozzle bar pivot point 111 as measured radially from the nozzle bar pivot point 111. The distance that the nozzle bar pivot point 111, and, consequently, the nozzle bar itself, moves is determined by the distance that the cam path 101 causes the cam following pin 105 to move. Thus, assuming negligible clearance between the cam following pin 105 and the cam path 101, as well as the pivot points 107,111, the distance $\Delta_n$ that each nozzle bar 79 is moved is determined by the axial displacement $\Delta_c$ of the cam path 101 approximately as follows, for small radial movements of lever arm 85:

$$\Delta_n = [(\Delta_c L_a)/L_c];\ [(\Delta_c L_a)/L_c]$$

$L_a$ = the distance between the stationary pivot point 107 and the nozzle bar pivot point 111;

$L_c$ = the distance between the stationary pivot point 107 and the cam following pin 105.

In order to vary the distance $\Delta_n$ that the nozzle bar 79 is moved during each rotation of the slotted drum 83, the nozzle bar pivot point 111 is made adjustable by providing a plurality of mounting locations 113 for the stationary pivot point 107. Thus, the bearing location (not shown in detail) which establishes the stationary pivot point 107 may be changed between the mounting locations 113. This change affects both the distance $L_a$ between mounting points 107, 111 and the distance $L_c$ between mounting point 107 and cam following pin 105 by equal linear distance. Since $L_a$ is larger than $L_c$, this change results in a larger proportional increase in $L_a$ than in $L_c$. Thus, if the distance $L_a$ between stationary pivot point 107 and pin 105 is reduced, the distance $\Delta_n$ that the nozzle bar 79 moves with each rotation of the drum 83 is increased.

While the movement of the nozzle bar 79 has been discussed, by moving the cylindrical member 99, the reciprocal movement of its respective nozzle bar 79 would not be affected by drivemotor 87.

With respect to FIGS. 2 and 5, each nozzle bar 79 carries a plurality of nozzles 121 along its length in an array or row which is parallel to the applicator edge 41 and the path of reciprocation of the bar so that nozzles 121 are moveable transversely of the path of travel F of the fabric 29. The individual nozzles 121 are each served by individual tubes 123 extended from one of several distributors 126, 127, 128 and 129. The construction of distributors 126–129 is similar to the construction of the main coating distributor 51 with the exception of the configuration of inner tube 53 and with electromagnetically operated fluid valves 131 being substituted for outlet ports 63. The tubes 123 are each connected to a valve 131.

The flow of materials such as additional dyestuff from distributors 126–129 is individually controlled by the electromagnetic valves 131. Typically, all the nozzles 121 of a given nozzle bar 79 are served from the same distributor and the tubes 123 are preferably all of equal length for each distributor 126–129 and small internal diameter to provide uniform flow resistance to dyes passing therethrough and to prevent dripping at the nozzles. This enables the tubes 113 to be rearranged if desired.

While distributors 126–129 are shown connected only to separate nozzle bars 81 by the tubes 113, it is contemplated that each distributor 126–129 may be connected to nozzles 121 on different nozzle bars 79.

Figure 7:
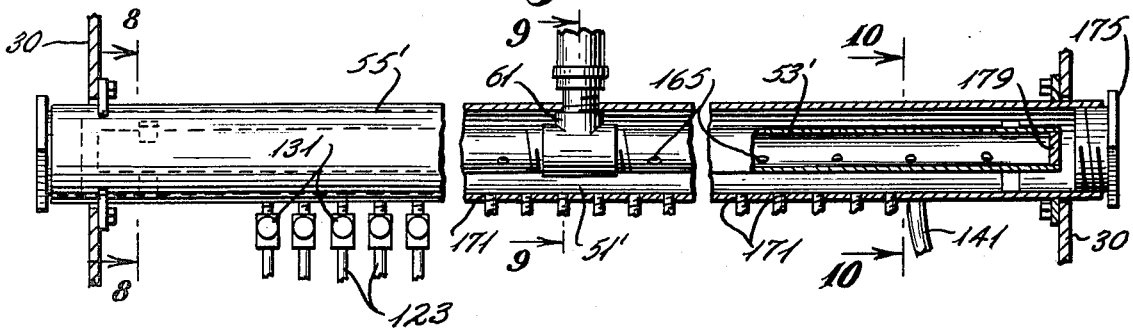
FIG. 7 shows a distributor used to provide material to the nozzle bar, taken on the line 7—7 of FIG. 3.
Figure 8:
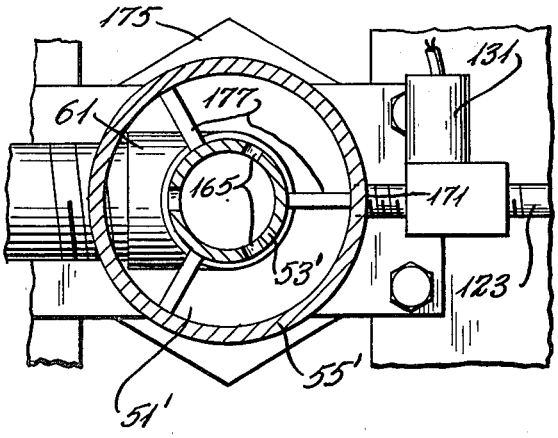
FIGS. 8–10 are sectional views of the coating distributor shown in FIG. 7, taken along sections 8—8, 9—9 and 10—10, respectively.
Figure 9:
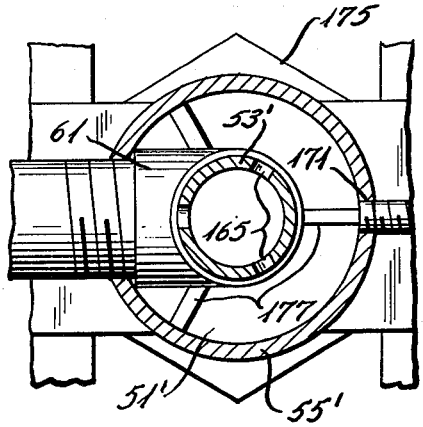
Figure 10:
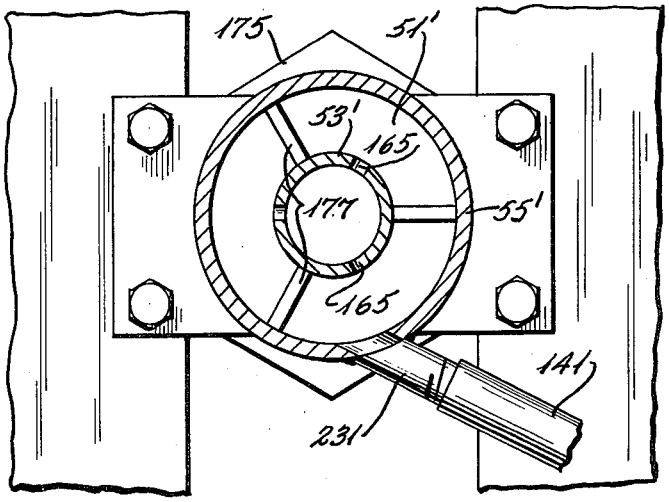

The distributors 126–129 conveniently are arranged in a vertical row and are individually served via a plurality of pumps (not shown) via lines 136, 137, 138 and 139, respectively. The distributors 126 also receive individual recycle drain lines 141 as shown in FIGS. 7 and 10 which are connected to the intakes of their respective pumps by any suitable means. The recycle drain lines 141 include individual valves (not shown) for opening and closing the recycle path.

Referring to FIGS. 7–10, each of the distributors 126–129 includes an inner tube 53' concentric with an outer tube 55' forming an annular chamber 57'. The inner tube 53' has a plurality of apertures 165 arranged in three rows which are positioned at 120° intervals about the periphery of the tube 53, thereby allowing the inner tube 53 to operate as a distribution manifold. A plurality of radially tapped holes 171 are provided along one side of each of the outer tubes 55', preferably at about 90° from the bottom out of alignment with apertures 165 and preferably equidistantly, as best shown in FIG. 7. The electromagnetic valves 131 are fitted into the tapped holes 171.

The configuration of the distributors is particularly advantageous in providing uniform, consistently reproducible flow rates through to the nozzles 121 and in eliminating or dampening pulsations from the pump serving the distributors 126–129.

It should be noted in FIG. 5 that the construction of main coating distributor 51 is similar to the construction of distributors 126–129 with parts 53–57 in the main coating distributor corresponding to parts 53'57' in distributors 126–129 as shown in FIGS. 7–10. One important difference is that, while outlet ports 63 in the main coating distributor 51 correspond to tapped holes 171, in distributors 126–129, the angular alignment of main coating distributor 51 is such that the outlet ports 63 are at the lower portion of the coating distributor 51. Also, the inner tube 53 of the main coating distributor 51 is provided with a continuous slot (not shown) along the top of inner tube 53. This feature gives a more uniform flow into the annular chamber 57 from outlet port 63.

Referring again to FIGS. 7–10, in order to maintain the concentric relationship of each inner tube 53' with each outer tube 55', a plurality of stud pegs 173 extends radially from the internal tubes 53'. These stud pegs 173 form spacers to maintain the axial alignment of tubes 53' and 55', while Tee fitting 61' connecting one of the lines 136–139 to each of distributors 126–129 maintains the rotational alignment of the tubes 53', 55'. A pair of pipe and plugs are used to seal each external tube 55', with the end plugs 175 forming stops to prevent longitudinal movement of the internal tubes 53' within the outer tubes 55'. As can be seen in FIG. 5, the main coating distributor 51 is likewise provided with corresponding stud pegs 177 and pipe and plugs 179 although the center of inner tube 53 is above the center of outer tube 55.

In operation, the main coating distributor 51 is used to provide a primary coating material which is deposited on applicator plate 39 from which the coating material is permitted to flow in a continuous sheet onto fabric 29. The primary coating material would normally be a dye base. While a primary coloring agent may be provided by distributors 126–129, normally this primary coloring agent is included with primary coating material. Distributors 126–129 are used to dispense additional coloring agents through nozzle bars 79, preferably onto the sheet of primary coating material while the primary coating material is still on the applicator plate 39.

In opertion of the preferred embodiment, several adjustments are to be made to accommodate the particular dyeing materials to be used. The applicator edge 41 is both substantially perpendicular to the path of travel of the pile fabric 29 and has a very close proximity thereto, in the order of from 0.1 mm to approximately 3 mm from the upper surface of the fabric at the ends of the tufts forming the pile. However, under certain circumstances, it is possible to hold applicator edge 41 higher than 3 mm. In addition to the height adjustment, the plate 39 is adjusted in slope for the general viscosity of the dye coating material and the extent of the lateral dispersion of additional coating materials coming from the nozzle bars 79 which is desired prior to delivery of the material onto the fabric. Generally the slope of the plate 39 will be in the order of about 2° to approximately 15° with respect to the horizontal, with the lower angles providing a slower progression of the material toward the edge 41 and a consequently increased opportunity for the materials to interdisperse before their delivery onto the fabric.

It is possible to permit a slope adjustment from a negative angle to an angle greater than 15°.

In order to control the slope of the plate, a plate bias adjustment means which may be manually operated (not shown) or operated by a slope-adjusting motor 191 as shown in FIG. 6.

In FIGS. 4, 6 and 11 the applicator plate 39 is supported by a carrier structure 193 which permits the applicator plate 39 (shown in FIGS. 4 and 6) to be horizontally and vertically moved. Horizontal movement of the carrier is effected by a horizontal adjustment motor 195 fixed to the carrier structure 193 effecting movement through a rack and pinion gear arrangement, the rack 197 being fixed to the frame 30 of the apparatus and the pinion 199 being directly driven by the motor 195. The horizontal adjustment is parallel to the direction of movement F of the fabric, thus moving the applicator plate 39 forward and backward with respect to the main coating distributor 51 and the tracks 77 for the reciprocating nozzle bars 79. It can therefore be seen that if the carrier 193 is moved forward, coating material effusing from the main coating distributor 51 would fall on the upper surface 47 of the applicator plate 39 further from the applicator edge 41 that if the carrier structure is moved forward in a direction opposite the direction of movement F of the fabric 29. In the preferred embodiment, the carrier would not be moved so far rearward that the coating material from the main coating distributor 51 would not reach the applicator plate 39; however, if a customer so desires, the carrier structure 193 may be permitted to move rearward enough to permit the applicator plate 39 to clear the nozzle bars.

The forward and rearward horizontal movement of the carrier structure 193 has a great effect on the additional coating material emitted from the reciprocated nozzle bars 79. It can be seen that the forward and rearward movement of the carrier structure 193 also affects the location of the desposition of additional coating materials from the nozzle bars 79 onto the upper surface 47 of the applicator plate 39, with a forward positioning of the carrier structure 193 resulting in these additional coating materials being deposited on the upper surface 47 from the edge 41, or even directly onto the fabric 29. By depositing the additional coating materials further from the edge 41, the additional coating materials are permitted to more thoroughly defuse while they are on the applicator plate 39 than if the additional coating materials are deposited on the applicator plate immediately adjacent the edge 41.

A vertical adjustment of the carrier structures 193 is effected by a vertical adjusting motor 201 turning worms 203 through inside-threaded sleeves 205 having acme threads. The inside-threaded sleeves 205 are vertically fixed to the carriers 193 but is permitted to horizontally slide with respect to the carrier.

The aforementioned slope adjustment of the applicator plate 39 is accomplished about a pivot axis 207 which is at the opposite end of the applicator plate 39 from the edge 41 and parallel to the edge. The fact that the pivot axis 207 is removed from the edge 41 means that adjustment of the slope results in a change in the vertical position of the edge 41. For this reason, a vertical adjustment of the carrier structures 193 must be effected by the vertical adjustment motor 201 in order to compensate for changes in the slope of the applicator plate 39, as well as to otherwise adjust the distance between the edge 41 and the fabric 29.

The slope-adjusting motor 191 is fixed to one of the carrier structures 193 and, as mentioned, is horizontally and vertically adjusted by the horizontal and vertical adjusting motors. The slope adjusting motor 191 turns a worm 209 which acts upon an externally threaded worm gear 211 which is coaxially aligned with the pivot axis 207. The slope-adjusting motor 191 is preferably the type used in servo systems, sometimes called a servo motor, and may be digitally controlled so as to precisely control the slope angle of the applicator plate 39, using angle adjustment control 212, shown in FIG. 3.

In FIG. 6, the various adjustments for the applicator plate, and particularly the horizontal and vertical adjustments, require that limit switches 213–221 be provided to prevent the applicator plate 39 from destructively engaging other parts of the apparatus. Specifically, limit switches 213 and 215 provide signals indicating a maximum forward and a maximum rearward horizontal travel, respectively, of the carrier structure 193. Limit switches 217 and 219 provide signals indicating a maximum upward and downward travel, respectively, of the carrier structure 193.

The signals from limit switches 213, 215, 217 and 219 are used to stop the appropriate horizontal and vertical adjustments of the carrier structure 193.

Limit switch 221 has two switching elements and is mounted on the applicator plate 39 near the pivot axis 207 to provide an indication of the angular position of the applicator plate 39. One switching element of limit switch 221 provides an indication whenever the application plate 39 is less than 2° or the edge 41 is higher than any point on the upper surface 47, indicating that the applicator plate 39 is tilted too high. The other switching element of limit switch 221 provides an indication when the angle of the upper surface exceeds 15° from the horizontal with the edge 41 below other points on the upper surface 47. Thus, limit switch 221 restricts the travel of the applicator plate 39 to between 2° and 15° downward.

Typically, the dyes or coatings used in the system of the present invention will have a viscosity in the order of from as low as 1 to 20 cps or as high as about 5000 cps, to permit direct penetration of the materials into the fabric as they are applied. It has been found that this preferred range affords a more uniform dyeing of the tufts with a lessened graduation of the color along the lengths of the tufts, thereby reducing the visual consequences of misalignment of installed carpet and reducing the noticeable changes in carpeting in heavy traffic wear areas.

In operation, it is possible to provide a single coating material to which coloring dye is mixed through the main coating distributor 51 or to provide coloring materials through distributors 126–129. By controlling the rate of reciprocation of the nozzle bars 79, as well as the slant of plate 39 and the relative position of plate 39 with respect to nozzle bars 79, the amount of intermingling of the various fluids, as well as the resultant pattern can be controlled. When it is desired to immediately cease dispensing of the materials, the appropriate valves 131 are shut off and the main coating cylinder 51 is retracted, thus preventing fluid from being exuded from outlet ports 63 and causing the fluid exuded from the outlet ports 63 to enter the recycling trough 65.

It is anticipated that the primary coating material supplied to the main coating distributor 51 may or may not be in the form of a foam. In order to provide foam, the main coating material must have a sufficient surface tension to maintain the foam in a stabilized form on the upper surface 47 of the applicator plate 39. In the fluid supply (not shown) to the flexible supply pipe 59 is provided a foamer (not shown) which injects air into the coating material before it enters the flexible supply pipe 59. When the foam is being pumped through the main coating distributor 51, a certain amount of this air will escape from the foamed coating material. In order to prevent the air which separates from the foam from creating air pockets and possibly surges, the air bleed lines 223 are connected to each end of the main coating distributor 51 through valves 225 located at the top of the external tube 55 as shown in FIG. 6. Air bleed lines 223 terminate at an end opposite valve 225 in the trough 65, permitting coating material expelled along with the air in the bleed line 223 to be recovered in the trough 65. A volume of fluid permitted to escape through air bleed line 223 is controlled by the pressure of the fluid in the annular chamber 57 of the main coating distributor 51, the setting of valve 225 and the viscosity of the fluid. Since air has much less viscosity than any of the liquids used for the coating material, any given setting of the valve 245 will permit a greater flow of air than of foamed or liquid coating materials, despite any siponic action of the air bleed line 223. This difference in flow rates is advantageous because it is desired to rapidly expel high concentrations of air in the annular chamber 57, while permitting only a relatively small amount of coating material to be bled from the main coating distributor 51 into the recycling trough 65.

Figure 3:
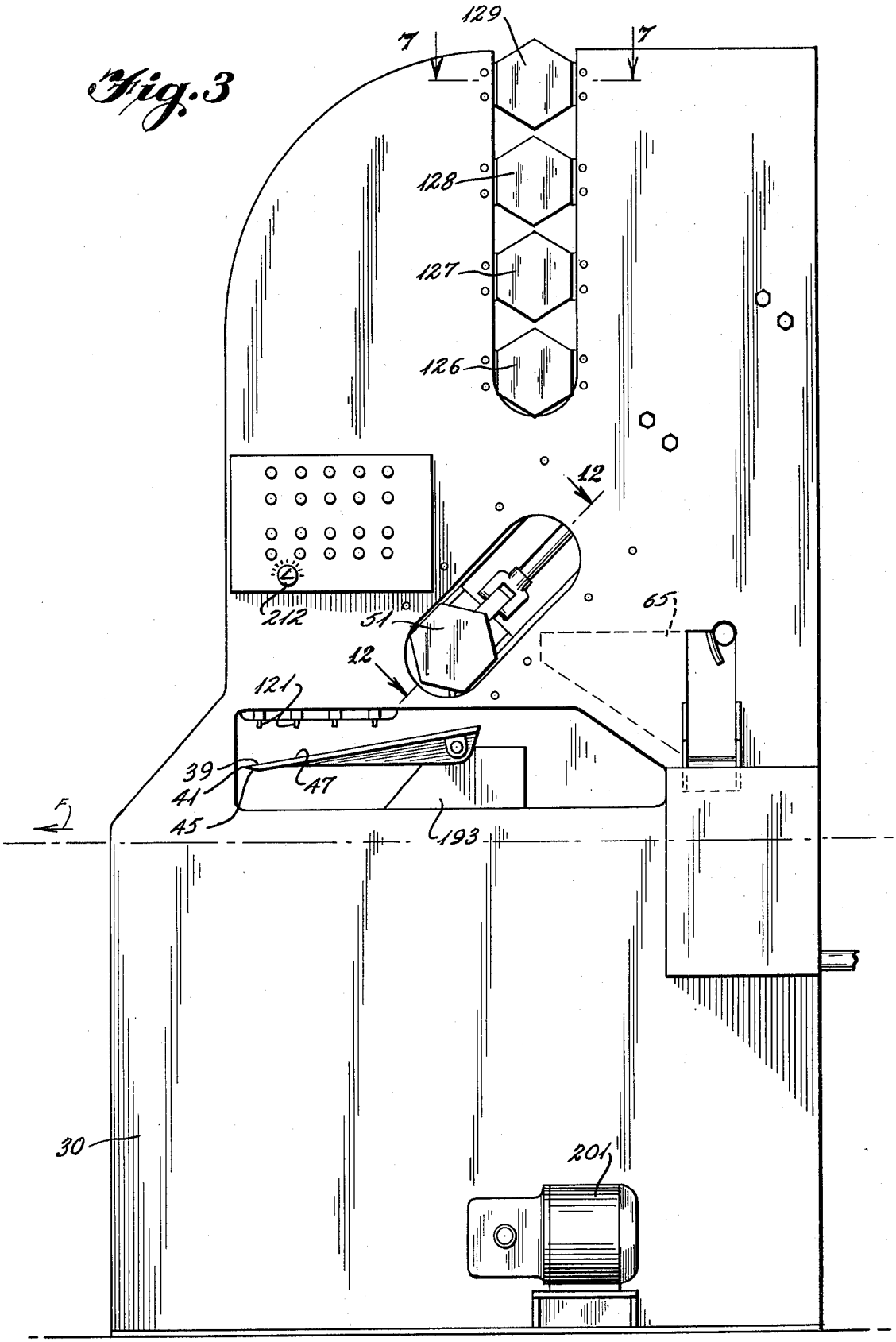
FIG. 3 is a left side view of the apparatus according to the invention showing the control apparatus.

The pneumatic cylinder 67, shown in FIGS. 3, 5 and 12, permits the fluid exuding from the main coating distributor 51 to be quickly and positively cut off in its flow onto the applicator plate 39 and the fabric 29. As previously mentioned, the retraction of the main coating distributor 51 by the pneumatic cylinders 67 places the outlet ports 63 directly over a recycling trough 65. In this manner, any fluid which is either within the inner tube 53 or in the annular chamber 57 does not continue to dribble onto the applicator plate 39 until the distributor 51 is empty. This is particularly advantageous when low-density, thick materials which would have a relatively slow flow rate, such as stabilized foam, are used as coating materials. As can be clearly seen, the flow rate of such materials no longer remains a significant factor in shut-off when the main coating distributor 51 is in its retracted position 69. An additional advantage of permitting the main coating distributor 51 to be retracted is that it is possible to supply the main coating distributor 51 with solvents such as water for internal cleaning purposes. In this case, not only does the trough 65 act as a drain basin for the solvents but permits the solvents to be recycled.

Because of the use of trough 65 for recycling dye materials as well, an irrigation pipe 227 runs along the top of the trough 65. The irrigation pipe 227 is fitted with spray openings which extend along its length and permit fluid to be sprayed into the troughs for cleaning purposes.

Additional cleaning may be effected by briefly cycling the pneumatic cylinder 67 with the appropriate cleaning solvent being injected into the coating distributor 51. This permits the cleaning solvent to be dispensed onto a drain board lip 229 extending between the recycling trough 53 and above the approximate position of the applicator plate 39, as well as onto the applicator plate 39.

Referring to FIGS. 5, 7 and 10, cleaning of distributors 126–129 connected to the reciprocating nozzle bars 79 is facilitated by providing a drainage port 231 connected to drain tube 141 shown in FIGS. 7 and 10 in each of the distributors 126–129. This permits the cleaning of the inner tubes 53' and the external tubes 55' with a fluid which is automatically drained from the annular chamber 57'. This also permits a drainage of the various additional coating materials such as dyes when it is desired to change the type of coating material in one of the distributors 126–129. If it is desired, it is then possible to use only a small amount of cleaning solvent to clean the tubes 123, valves 131 and nozzles 121. This solvent may be recovered by a tray or similar basin (not shown) which may be placed on the dye line 31 below the edge 41 of the applicator plate 39.

It is anticipated that, in the case of fabrics with a dense pile, a doctor blade (not shown) may be provided to compress the foam coating materials into the fabric 29. This doctor blade would merely be a plate having a lower edge parallel to that of the edge 41 of applicator plate 39. The doctor blade would be mounted above the dye line 31 downstream of edge 41. The doctor blade would be angled to slope downward in the direction of travel F with its edge furthest downstream and close to or touching the fabric 29.

While the above description is directed to dyeing techniques, it is anticipated that other substances may be applied either alone or in conjunction with dye coating materials. For example, an antisoiling agent such as Scotchguard (TM, 3-M Company) or a material to add texture may be selectively applied by the system.

It is also possible to modify the specific structure which has been described. It should thus be clear that it is not intended that the apparatus or the techniques should be limited to the description of the preferred embodiment.

I claim:

1. Apparatus for producing dye coloration in fabric comprising:

(a) a supporting bed for supporting the fabric substantially horizontally;

(b) an applicator member including (i) an applicator edge positionable across the width of a moving length of said fabric, and (ii) a smooth upper surface inclined toward said applicator edge;

(c) means for delivering a primary coating material onto said smooth upper surface to form a continuous sheet thereof flowing by gravity toward said applicator edge, the means including a conduit having a plurality of outlet ports spaced apart in a row extending across the supporting bed; and (d) foamer means for causing the coating material to be in a foamed condition as it is delivered from the outlet ports and as it forms the continuous sheet.

2. The apparatus of claim 1 further comprising a distribution means including:

(a) at least one array of nozzles positioned for delivery of at least one additional coating material onto the continuous sheet upstream of said applicator edge, and (b) delivery means for selectively delivering additional coating material through selected nozzles of said array of nozzles to interdisperse with the continuous sheet material while upon said upper applicator surface.

3. The apparatus of claim 2 including means for reciprocating at least a portion of said nozzle array transversely with regard to the path of travel of the fabric.

4. The apparatus of claim 2 wherein:

(a) said array of nozzles includes at least one row of nozzles aligned transversely of the path of travel of the fabric;

(b) said delivery means further includes an elongate distributor member having a plurality of apertures therein, a plurality of conduits in individual communication between one of said distributor apertures and one of said nozzles;

(c) said conduits including a flexible duct and a valve, and (d) said flexible ducts being of sufficiently low flow area to comprise flow-stabilizing resistance lines, whereby dripping of material at said nozzles is precluded when said valve in said conduit is closed.

5. The apparatus of claim 1 further comprising:

(a) a recycling trough, and (b) a means to selectively reciprocate the means for delivering the primary coating material to a position over said applicator member or to a position over said recycling trough.

6. The apparatus of claim 1 in which said applicator member is positionable at differing positions with regard to said means for delivering along the path of travel of the fabric.

7. The apparatus of claim 6 in which said applicator upper surface is adjustable in its incline toward said applicator edge.

8. The apparatus of claim 1 in which said conduit includes an inner pipe concentric with an outer pipe, the inner and outer pipes forming an annular chamber communicating with the outlet ports, said inner pipe including a plurality of groups of multiple apertures positioned equidistantly from each other about the circumference of said inner pipe, and said outlet ports are arcuately intermediate and equidistant from adjacent said apertures.

9. The apparatus of claims 1 or 8, further comprising:

(a) a recycling trough, and (b) a means for reciprocating the means for delivering so that in an "ON" mode, the means for delivering is over smooth upper surface, and in an "OFF" mode, the means for delivering is over the recycling trough, thus preventing the coating material from flowing onto said smooth upper surface in the "OFF" mode.

10. An apparatus for producing dyed patterns in fabrics including tufted pile fabrics comprising:

(a) a reservoir for at least one coating substance;

(b) an inner pipe maintained parallel to the fabric to be dyed, the inner pipe having a plurality of apertures along its length;

(c) an outer pipe concentric with the inner pipe and having a plurality of outlet ports spaced in a row along a bottom portion of the outer pipe, the inner and outer pipes forming an annular chamber communicating with the outlet ports and the plurality of apertures;

(d) a means to supply a coating substance from the reservoir to the inner pipe comprising a feed line and a connection fitting connecting the inner pipe with the feed line;

(e) an applicator plate having a smooth upper surface, the applicator plate extending in a direction parallel to the center axis of said concentric pipes and having an adjustable angle with respect to a horizontal plane;

(f) a recycling trough;

(g) a means to reciprocate said concentric pipes so that in an "ON" mode, the outlet ports are over the applicator plate and in an "OFF" mode, the outlet ports are over the recycling trough, and (h) a means to move fabrics below said applicator plate.

11. The apparatus of claim 10 wherein the means to supply further comprises a means to foam said coating substance so that the coating substance is discharged from said outlet ports as a foam.

12. The apparatus of claim 11 further comprising an air bleed means to extract excess air from the means to supply.

13. The apparatus of claim 10 further comprising a means for adding additional fluid supply means wherein additional material from the additional supply means may be discharged onto said applicator plate to be intermingled with said material from said reservoir.

14. An apparatus for producing dye patterns in fabric comprising:

(a) a supporting bed for supporting the fabric substantially horizontally;

(b) an applicator member having (i) an applicator edge, the applicator edge being positionable across the width of a moving length of said fabric;

(ii) a smooth upper surface inclined toward said applicator edge;

(c) means for delivering a primary coating material onto said smooth upper surface across the width of the fabric to form a continuous sheet thereof flowing by gravity toward said applicator edge;

(d) foamer means for causing the coating material to be in a foamed condition as it is delivered from the means for delivering and as it forms the continuous sheet;

(e) at least one array of nozzles positioned for delivery of at least one additional coating material onto the continuous sheet upstream of said applicator edge; and (f) delivery means for selectively delivering the additional coating material through selected nozzles of said array of nozzles to interdisperse with the continuous sheet of foamed primary coating material while upon said smooth upper surface.

15. The apparatus of claim 14 including means for reciprocating at least a portion of said nozzle array transversely with respect to the path of travel of the fabric.

16. The apparatus of claim 14 further comprising (a) a recycling trough, and (b) a means to selectively reciprocate the means for delivering the primary coating material to a position over said applicator plate or to a position over said recycling trough.

* * * * *